US006427672B1

(12) United States Patent
Ito et al.

(10) Patent No.: US 6,427,672 B1
(45) Date of Patent: Aug. 6, 2002

(54) VALVE-OPERATING DEVICE WITH BREATHER SYSTEM IN ENGINE

(75) Inventors: Keita Ito; Takao Nishida; Shigeki Edamatsu, all of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/901,568

(22) Filed: Jul. 11, 2001

(30) Foreign Application Priority Data

Jul. 11, 2000 (JP) ..... 2000-215852

(51) Int. Cl.[7] ..... F01M 13/00
(52) U.S. Cl. ..... 123/572
(58) Field of Search ..... 123/572, 573, 123/574, 41.86

(56) References Cited

U.S. PATENT DOCUMENTS 4,881,510 A * 11/1989 Etoh et al. ..... 123/572
5,261,380 A * 11/1993 Romano ..... 123/573
5,947,068 A * 9/1999 Araki ..... 123/572
6,152,119 A * 11/2000 Hoshiba et al. ..... 123/572

FOREIGN PATENT DOCUMENTS

JP 1-148009 10/1989

* cited by examiner

*Primary Examiner*—Marguerite McMahon
(74) *Attorney, Agent, or Firm*—Armstrong, Westerman & Hattori, LLP.

(57) ABSTRACT

In a valve-operating device with a breather system in an engine, in which a breather passage is defined in a cam shaft, a bearing cap is detachably secured to the engine body for supporting an outer peripheral surface of one end portion of the camshaft with a bearing. A breather chamber is provided in the bearing cap in order to communicate with the outlet of the breather passage. A pipe-connecting portion is integrally formed on an outer peripheral surface of the bearing cap; and a breather pipe connected to an intake system is connected to the pipe-connecting portion. Thus, a blow-by gas can be drawn through the breather passage in the valve-operating camshaft to the outside by utilizing a portion of a valve-operating camshaft supporting structure. It is thus possible to simplify the structure of the valve-operating device with the breather system.

2 Claims, 16 Drawing Sheets

12
5
71
53
E
34
74
31
29
33
27'
35
27
24
25
26
30
28
21
8
1
22
23
10
37
9
38
60
36
40
18
8a
19
7
15
56
7a
6
84
56a
17
40a
5
16
6R
6L
43
57
17'
41
14
14'
55
6a
39
O
64
13
39'
32
63
6
86
56b
62
61
65
12
12
6

VALVE-OPERATING DEVICE WITH BREATHER SYSTEM IN ENGINE

BACKGROUND OF THE INVENTION

1. Field of the Invention

The present invention relates to an improvement in a valve-operating device with a breather system in an engine. In this invention, a breather passage is defined in a camshaft disposed in a valve-operating cam chamber and carried on an engine body in such a manner that an inlet of the breather passage opens to an outer peripheral surface of the camshaft and an outlet of the breather passage communicates with an intake system. Consequently, the gas-liquid separation, i.e., the separation of an oil and a blow-by gas from each other, is conducted in the inlet of the breather passage in the camshaft by centrifugal force, and only the blow-by gas is guided into the breather passage.

2. Description of the Related Art

Such a valve-operating device with a breather system in an engine is already known, for example, as disclosed in Japanese Utility Model Application Laid-open No. 1-148009.

In the valve-operating device with the breather system in the engine disclosed in the above Japanese Utility Model Laid-open, a camshaft-supporting structure and a structure of drawing the blow-by gas from the breather passage in the camshaft to the outside are provided independently from each other. For this reason, such valve-operating device has a disadvantage in that the entire structure is complicated, whereby it is difficult to reduce the cost.

SUMMARY OF THE INVENTION

Accordingly, it is an object of the present invention to provide a valve-operating device of the above-described type with a breather system in an engine, wherein the blow-by gas is drawn from the breather passage in the camshaft to the outside by utilizing the camshaft-supporting structure, leading to a simplified entire structure and a reduced number of parts.

In order to achieve the above object, according to a first aspect and feature of the present invention, there is provided a valve-operating device with a breather system in an engine, including a breather passage, which is defined in a camshaft disposed in a valve-operating cam chamber and carried on an engine body in such a manner that an inlet of the breather passage opens to an outer peripheral surface of the camshaft and an outlet of the breather passage communicates with an intake system. In this invention, a bearing cap is detachably secured to the engine body for supporting an outer peripheral surface of one end portion of the camshaft with a bearing interposed therebetween, the bearing cap having a breather chamber provided therein to communicate with the outlet of the breather passage, the bearing cap also being integrally formed at an outer peripheral surface thereof with a pipe-connecting portion to which a breather pipe communicating with the breather chamber and connected to the intake system is connected.

With the above structural arrangements, the bearing cap also serves as a delivery member for delivering the blow-by gas to the breather pipe; and hence, it is possible to simplify the structure and reduce the number of parts to contribute to a reduction in cost.

According to a second aspect and feature of the present invention, in addition to the first feature, the bearing is a sealed bearing including a seal member on a side facing the breather chamber.

With the above structural arrangements, the bearing can be lubricated by an oil mist within the valve-operating cam chamber, and the entering of the oil mist into the breather chamber can be prevented by the bearing.

The above and other objects, features and advantages of the invention will become apparent from the following description of the preferred embodiment taken in conjunction with the accompanying drawings.

DESCRIPTION OF THE PREFERRED EMBODIMENT

The present invention will now be described by way of an embodiment shown in the accompanying drawings.

Figure 1:
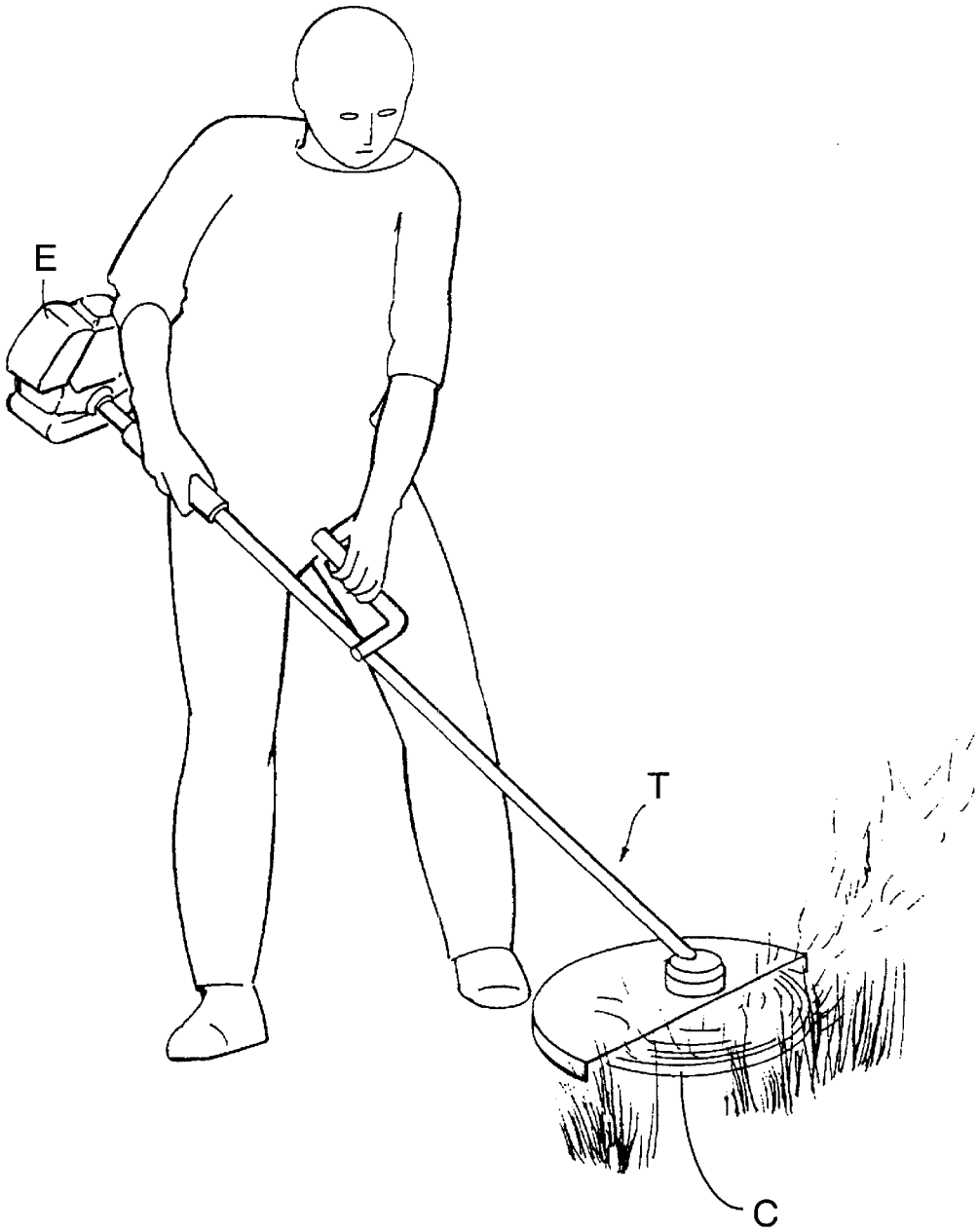
FIG. 1 is a perspective view of one application of a hand-held type 4-cycle engine according to the present invention.

As shown in FIG. 1, a hand-held type 4-cycle engine E is attached as a power source, for example, for a power trimmer T, to a drive section of the power trimmer T. The power trimmer T is used with its cutter C positioned in various directions depending on a working state thereof. Consequently, in each case, the engine E is also inclined to a large extent, or turned upside down. Therefore, the operational position of the power trimmer T is variable.

First, the entire arrangement of the hand-held type 4-cycle engine E will be described with reference to FIGS. 2 to 5.

Figure 2:
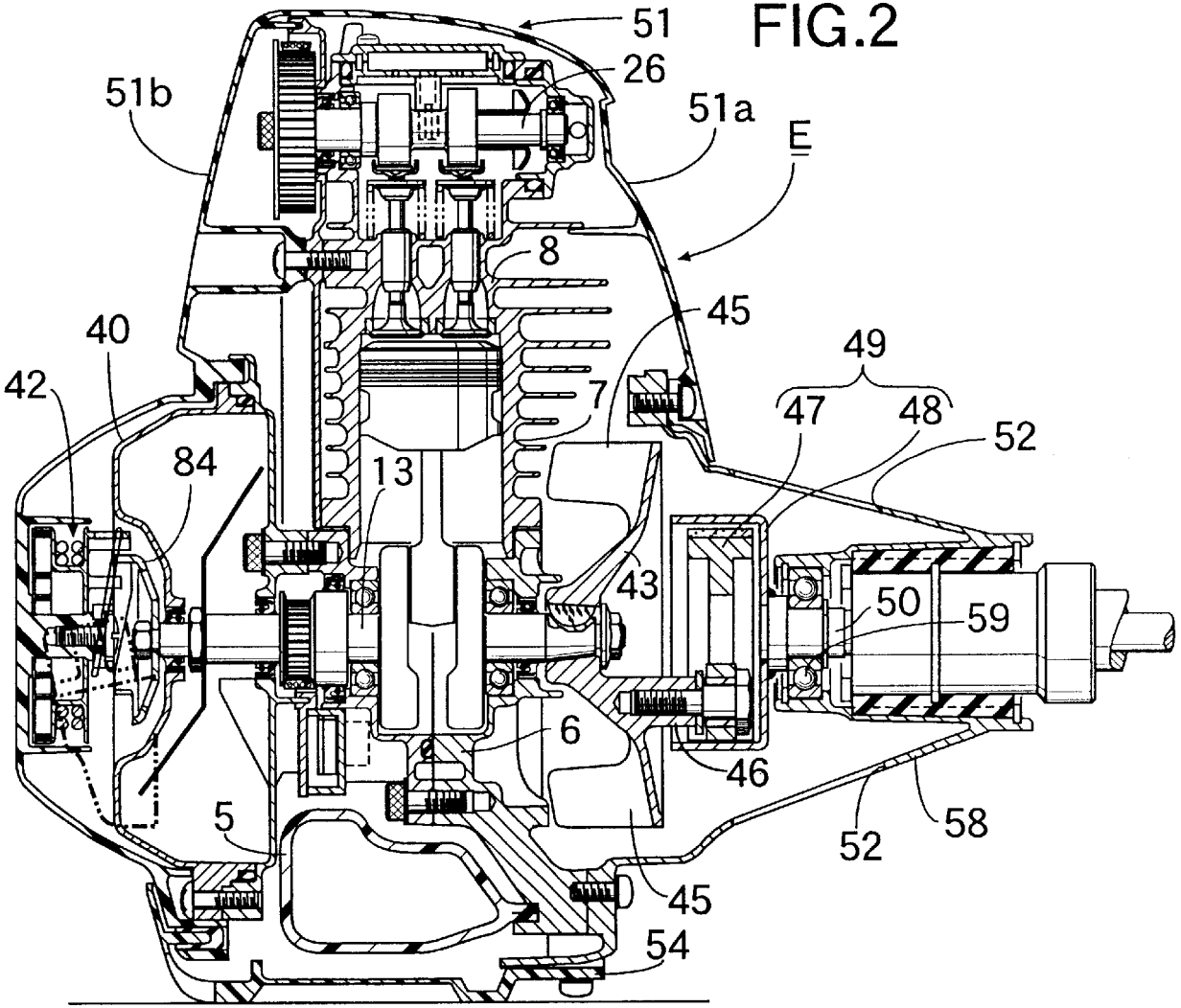
FIG. 2 is a vertical sectional side view of the 4-cycle engine.
Figure 3:
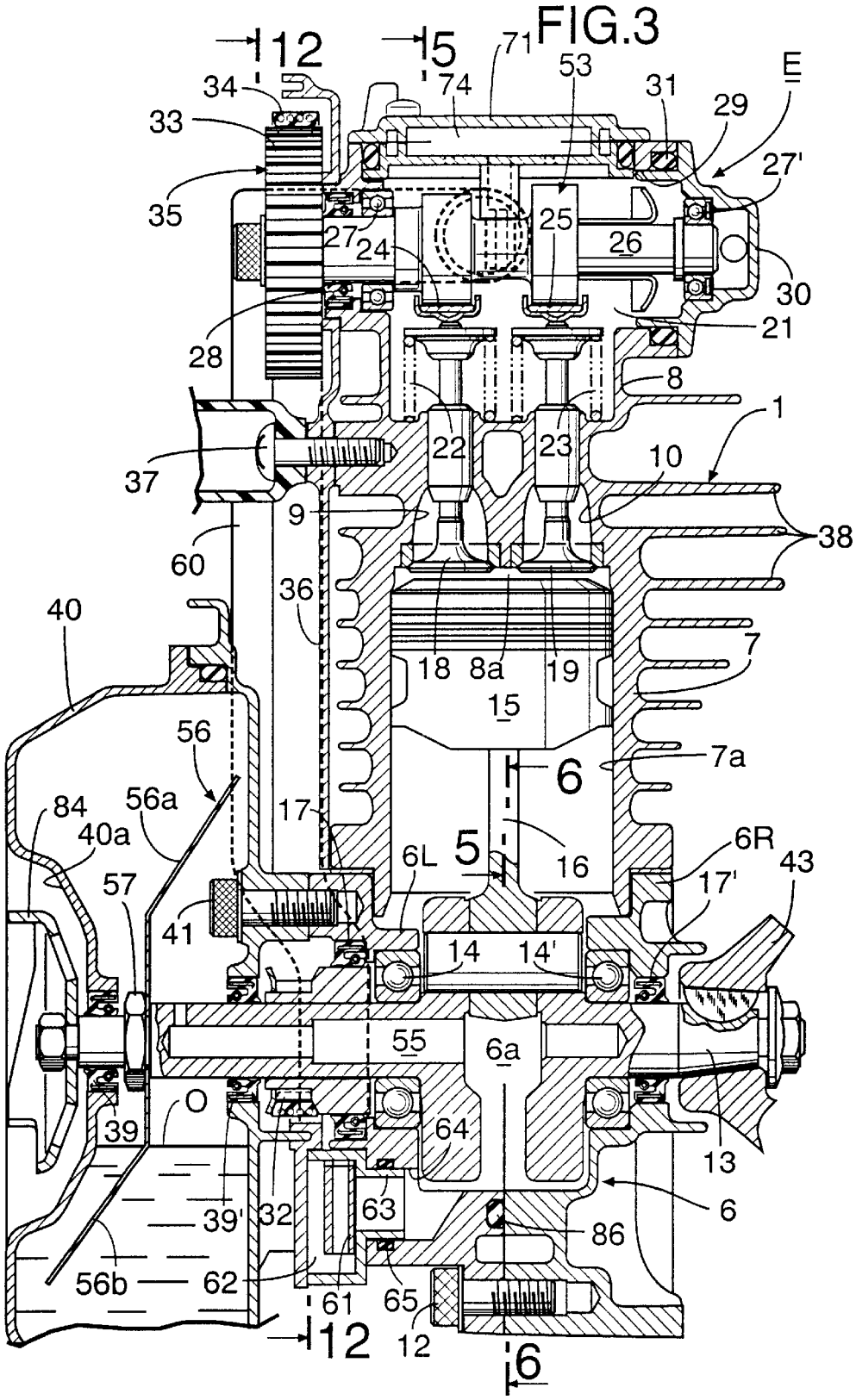
FIG. 3 is an enlarged view of an essential portion shown in FIG. 2.
Figure 5:
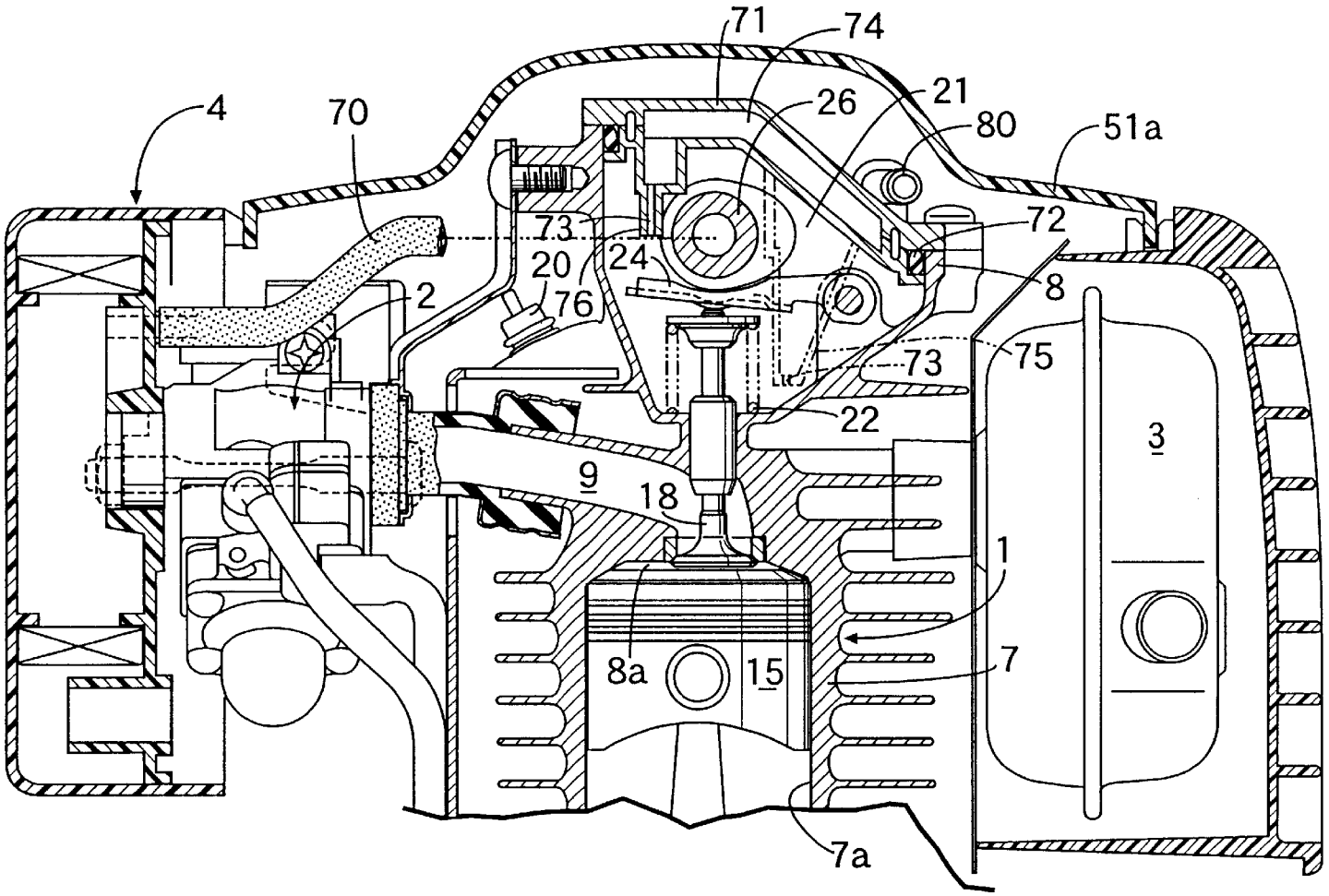
FIG. 5 is a sectional view taken along a line 5—5 in FIG. 3.
Figure 6:
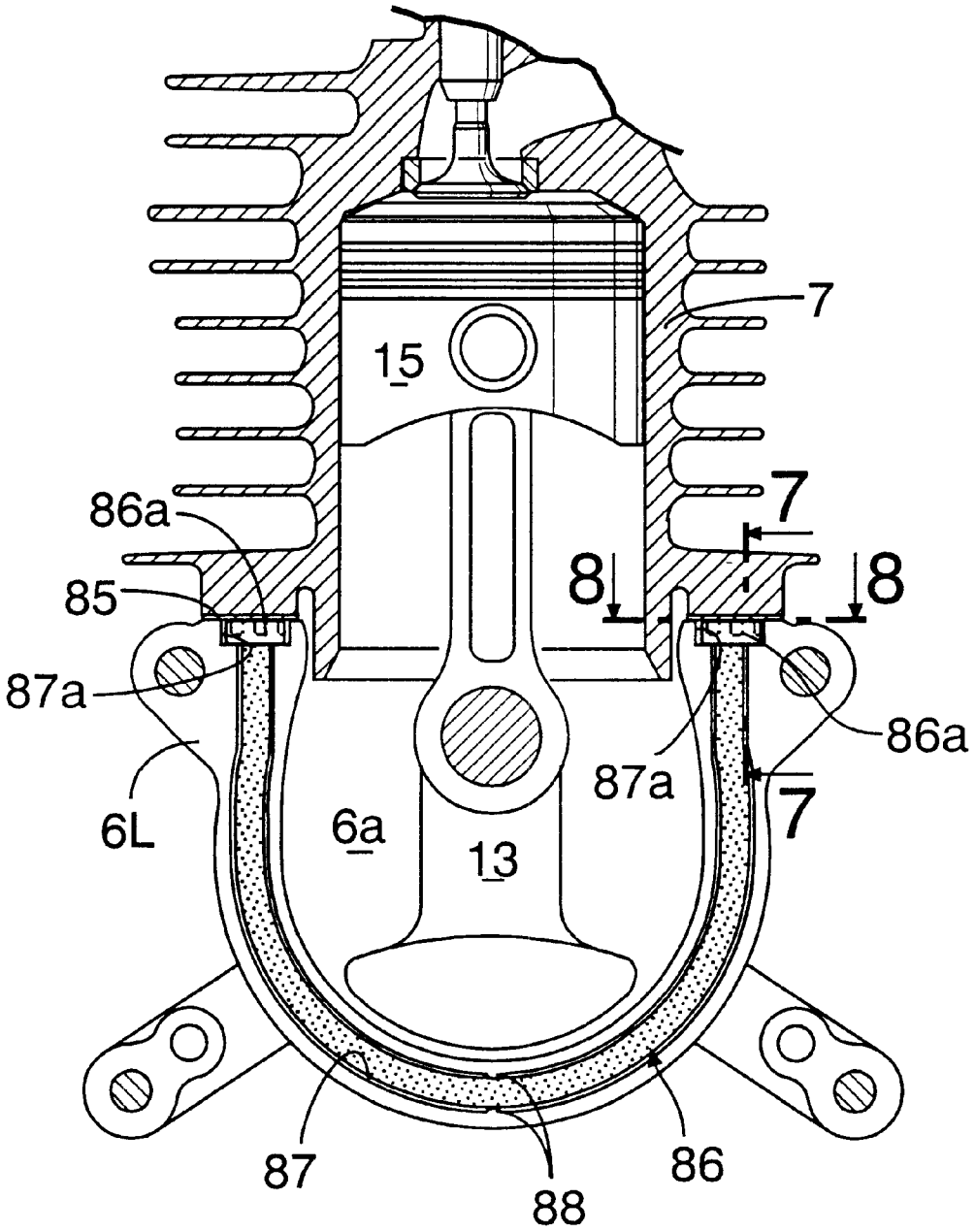
FIG. 6 is a sectional view taken along a line 6—6 in FIG. 3.
Figure 7:
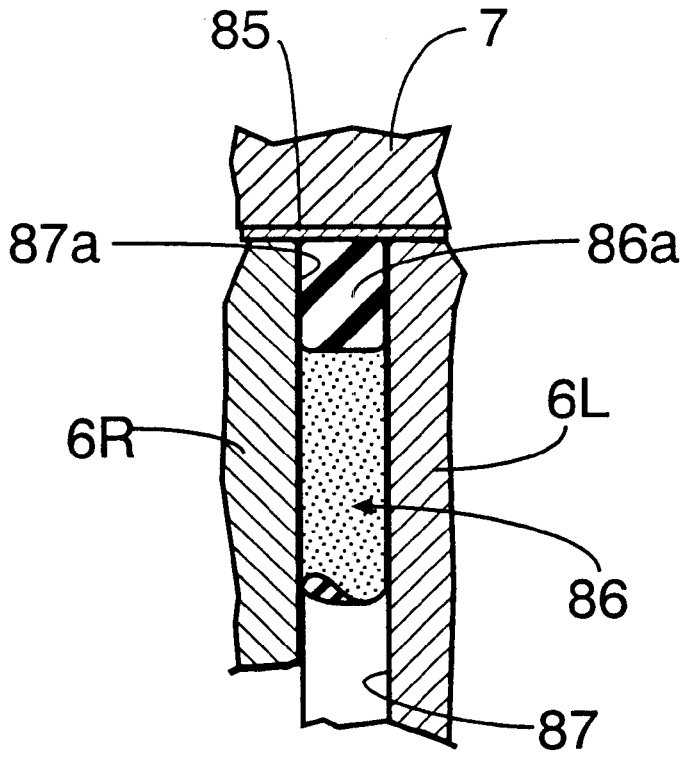
FIG. 7 is a sectional view taken along a line 7—7 in FIG. 6.
Figure 8:
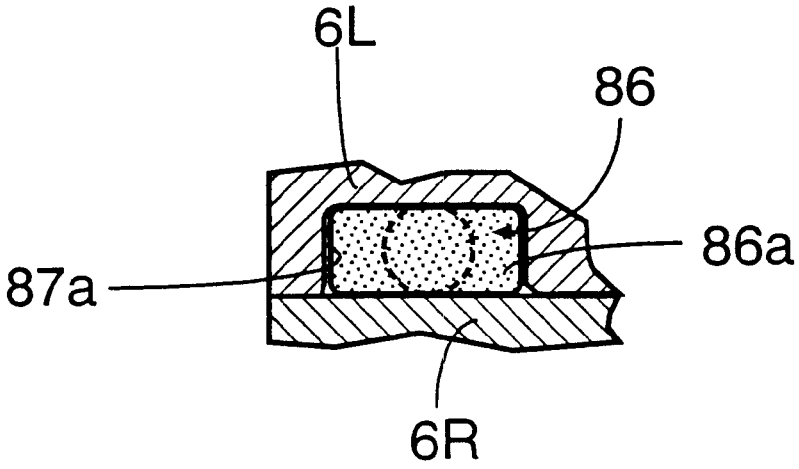
FIG. 8 is a sectional view taken along a line 8—8 in FIG. 6.
Figure 9:
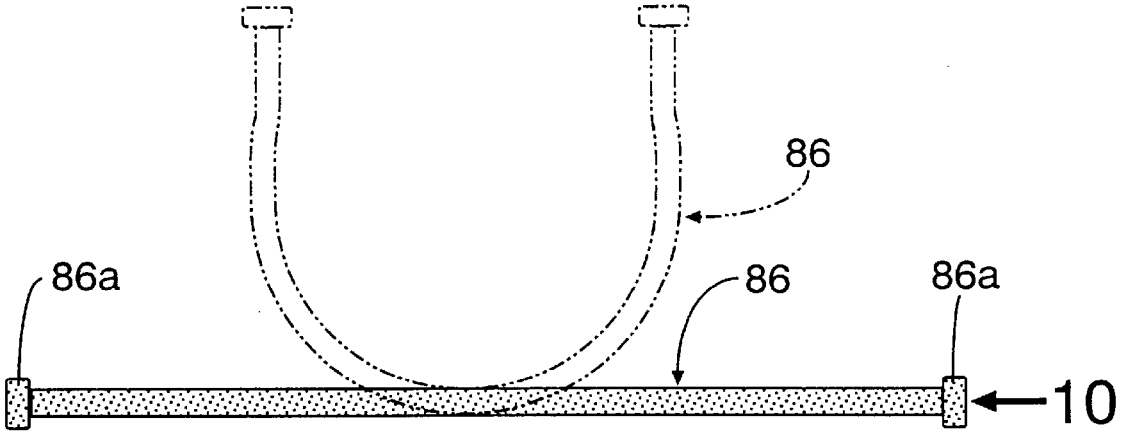
FIG. 9 is a front view of a bar-shaped seal member.
Figure 10:
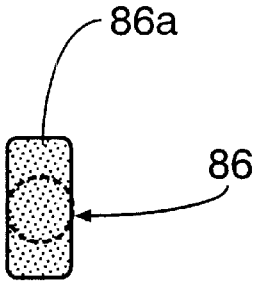
FIG. 10 is a view taken in a direction of an arrow 10 in FIG. 9.

As shown in FIGS. 2, 3 and 5, a carburetor 2 and an exhaust muffler 3 are mounted at front and rear locations on an engine body 1 of the hand-held type 4-cycle engine E, respectively; and an air cleaner 4 is mounted at an inlet of an intake passage of the carburetor 2. A fuel tank 5 made of a synthetic resin is mounted to a lower surface of the engine body 1.

The engine body 1 comprises a crankcase 6 having a crank chamber 6*a,* a cylinder block 7 having a single cylinder bore 7*a,* and a cylinder head 8 having a combustion chamber 8*a* and intake and exhaust ports 9 and 10, which open into the combustion chamber 8*a*. The cylinder block 7 and the cylinder head 8 are formed integrally with each other by casting, and the crankcase 6 formed separately from the cylinder block by casting is bolt-coupled to a lower end of the cylinder block 7. The crankcase 6 is comprised of first and second case halves 6L and 6R partitioned laterally from each other at a central portion of the crankcase 6 and coupled to each other by bolts 12. A large number of cooling fins 38 are formed around an outer periphery of each of the cylinder block 7 and the cylinder head 8.

A crankshaft 13 accommodated in the crank chamber 6*a* is rotatably carried on the first and second case halves 6L and 6R with ball bearings 14 and 14' interposed therebetween, and is connected through a connecting rod 16 to a piston 15 received in the cylinder bore 7*a*. Oil seals 17 and 17' are mounted on the first and second case halves 6L and 6R outside and adjacent to the bearings 14 and 14' to come into close contact with an outer peripheral surface of the crankshaft 13.

As shown in FIGS. 3 and 6 to 8, a gasket 85 is interposed between joints of the cylinder block 7 and the first/second case halves 6L/6R. A bar-shaped seal member 86 is interposed between the first and second case halves 6L and 6R in the following manner: A U-shaped seal groove 87 is formed in one of joints of first and second case halves 6L and 6R to extend along an inner peripheral surface of such one joint, and an enlarged recess 87*a* extending over the joints of the case halves 6L and 6R is formed at each of opposite ends of the seal groove 87 on the side of the cylinder block 7. On the other hand, the seal member 86 is made of an elastomeric material; such as, a rubber and has a bar-shaped portion circular in section. Enlarged end portions 86*a* square in section are formed at opposite ends of the seal member 86 to protrude perpendicularly sideways in opposite directions. The seal member 86 is fitted into the seal groove 87, while the bar-shaped portion is being bent into a U-shape, with the enlarged end portions 86*a* filled in the enlarged recesses 87*a*. In this case, it is effective for preventing the floating of an intermediate portion of the seal member 86 from the seal groove 87 to form a pair of small projections 88 on an inner surface of an intermediate portion of the seal groove 87 so that the projections 88 come into resilient contact with an outer peripheral surface of an intermediate area of the bar-shaped portion.

When the first and second case halves 6L and 6R are coupled to each other, outer surfaces of the bar-shaped portion and the enlarged ends 86*a* of the seal member 86 are put into close contact with the opposed mating joint surfaces. When the cylinder block 7 is coupled to the upper surfaces of the case halves 6L and 6R with the gasket 85 interposed therebetween, upper surfaces of the enlarged ends 86*a* are put in close contact with the gasket 85. In this manner, the joint surfaces of the case halves 6L and 6R and the cylinder block 7 intersecting each other in a T-shape are sealed by the single seal member 86 and the single gasket 85. Especially, the entire seal member 86 can be retained accurately at a fixed position without the need for a special skill, by the fitting of the pair of enlarged ends 86 in the enlarged recesses 87*a*. Moreover, interferences for the bar-shaped portion and the enlarged ends 86*a* of the seal member 86 are determined by depths of the seal groove 87 and the enlarged recesses 87*a* for accommodation of the bar-shaped portion and the enlarged ends 86*a,* and little influenced by a variation in pressure of coupling between the joint surfaces. Therefore, it is possible to reliably achieve the sealing of the intersecting joint surfaces, while providing an enhancement in the assembling of the engine body 1.

Referring again to FIGS. 4 and 5, an intake valve 18 and an exhaust valve 19 are mounted in the cylinder head 8 in parallel to an axis of the cylinder bore 7*a* for opening and closing the intake port 9 and the exhaust port 10, respectively. A spark plug 20 is threadedly mounted with its electrode disposed in proximity to a central portion of the combustion chamber 8*a*.

The intake valve 18 and the exhaust valve 19 are urged to closing directions by valve springs 22 and 23 in a valve-operating cam chamber 21 defined in the cylinder head 8. In the valve-operating cam chamber 21, rocker arms 24 and 25 vertically swingably superposed on the cylinder head 8 are superposed on heads of the intake valve 18 and the exhaust valve 19. A cam shaft 26 for opening and closing the intake valve 18 and the exhaust valve 19 through the rocker arms 24, 25 are rotatably carried on laterally opposite sidewalls of the valve-operating cam chamber 21 in a parallel to the crankshaft 13 with ball bearings 27 and 27' interposed therebetween. One of the sidewalls of the valve-operating cam chamber 21, on which one of the ball bearings 27 is mounted, is formed integrally with the cylinder head 8, and an oil seal 28 is mounted on such one sidewall adjacent to and outside the bearing 27 to come into close contact with an outer peripheral surface of the cam shaft 26. An insertion hole 29 is provided in the other sidewall of the valve-operating cam chamber 21 to enable the insertion of the camshaft 26 into the chamber 21, and the other ball bearing 27' is mounted on a bearing cap 30 adapted to close the insertion hole 29 after insertion of the camshaft 26. The bearing cap 30 is fitted into the insertion hole 29 with a seal member 31 interposed therebetween, and is bolt-coupled to the cylinder head 8.

Figure 4:
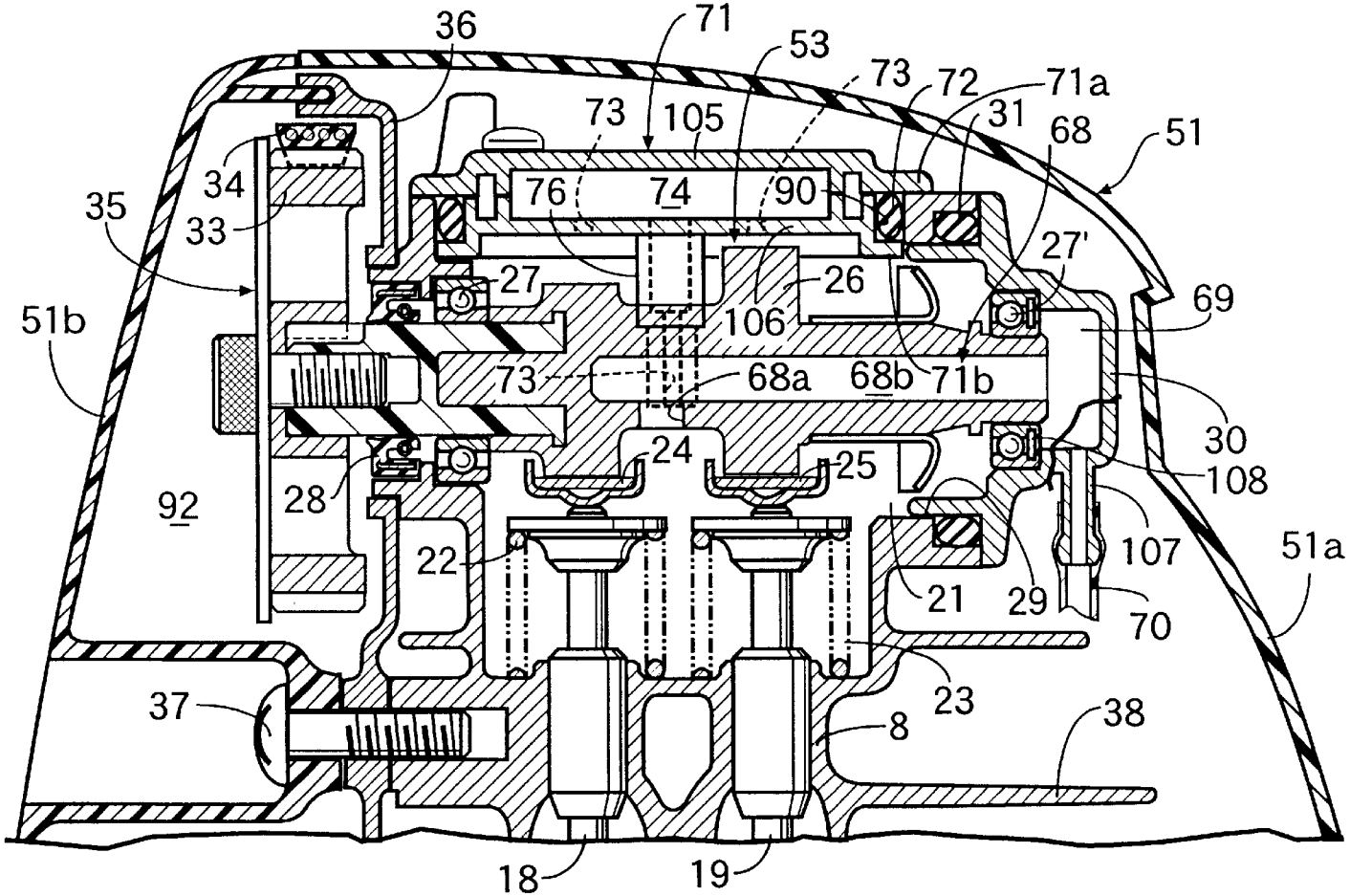
FIG. 4 is an enlarged vertical sectional view of a section around a camshaft shown in FIG. 3.
Figure 11:
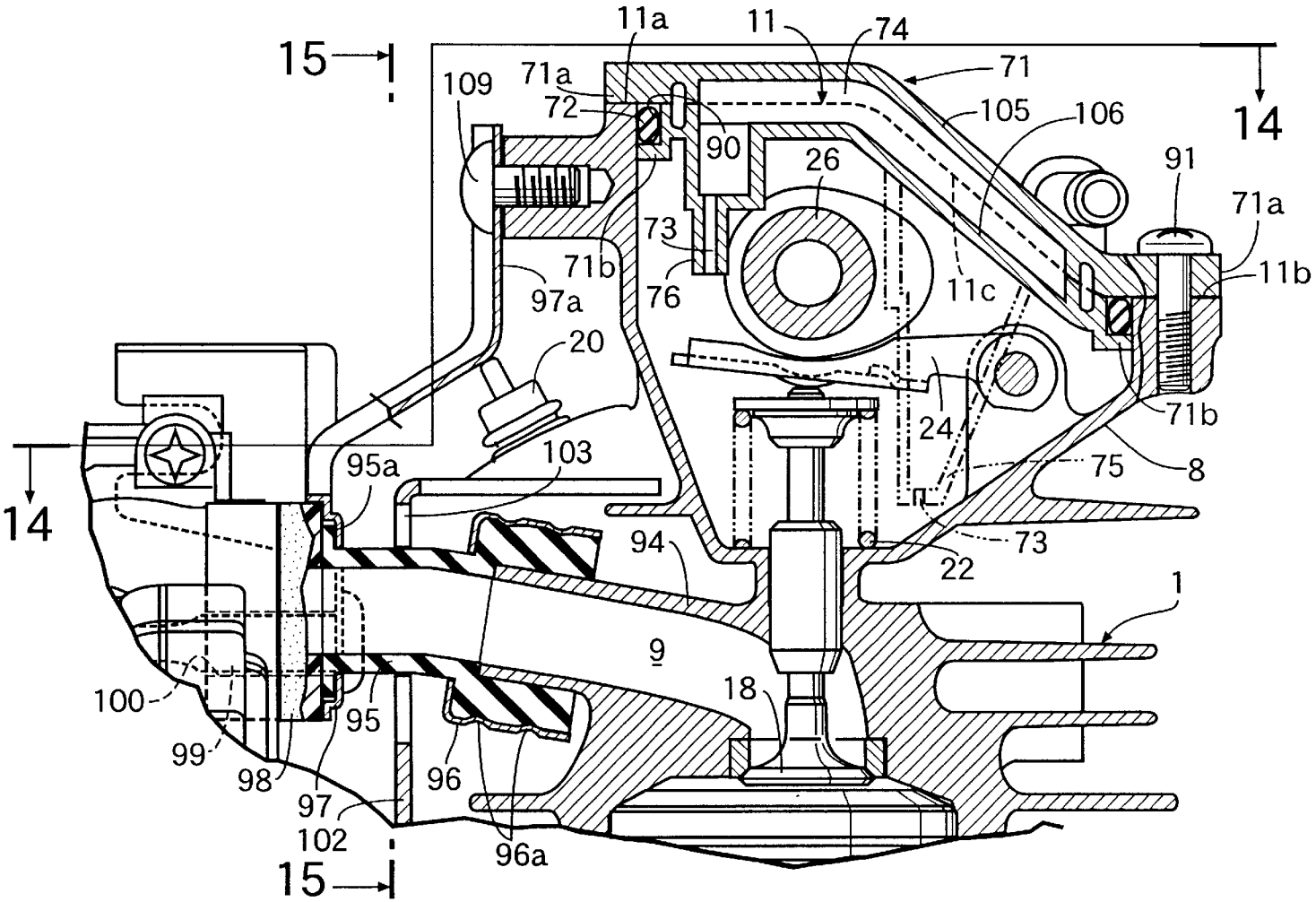
FIG. 11 is an enlarged view of an essential portion shown in FIG. 5.
Figure 16:
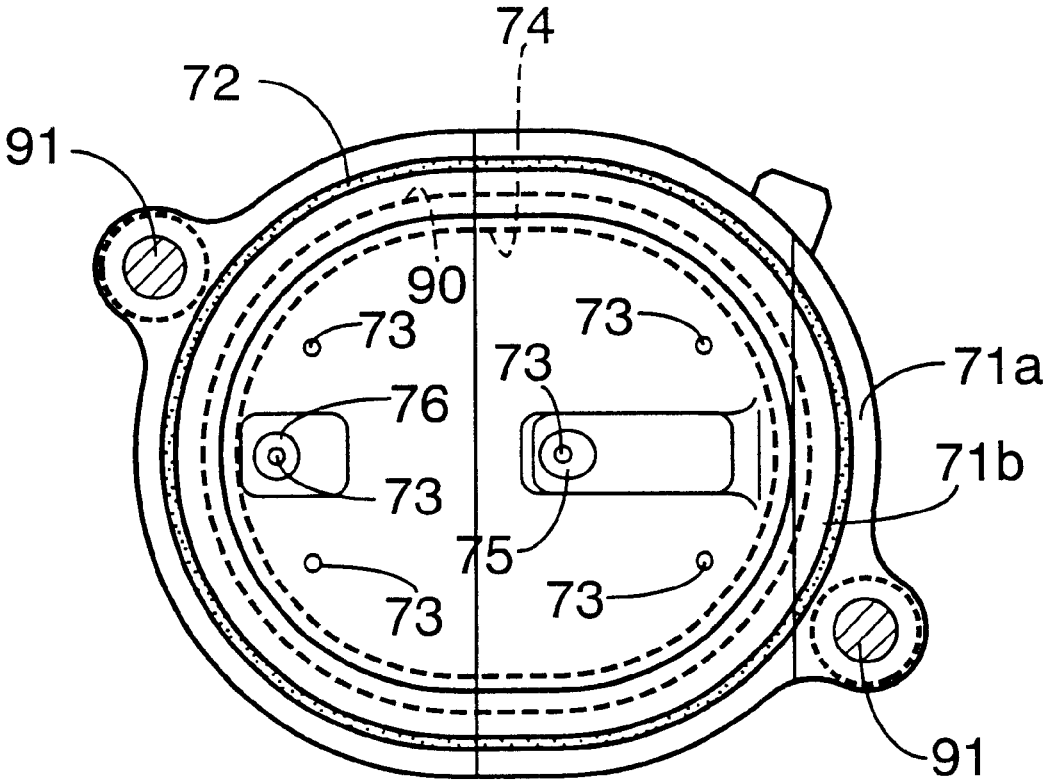
FIG. 16 is a bottom view of a head cover.

As best shown in FIGS. 4, 11 and 16, a head cover 71 is coupled to an upper end face of the cylinder head 8 in order to close an open surface of the valve-operating cam chamber 21.

The upper end face 11 of the cylinder head 8 is comprised of a slant 11*c* inclined downwards from the side of the camshaft 26 toward a fulcrum of a swinging movement of the rocker arms 24 and 25, and a pair of flat face portions 11*a* and 11*b* connected to opposite ends of the slant 11*c* and parallel to each other at different height levels. The head cover 71 is formed with a flange portion 71*a* superposed on the upper end face 11 of the cylinder head 8, and a fit wall 71*b* fitted to an inner peripheral surface of the valve-operating cam chamber 21. An annular seal groove 90 is provided in an outer peripheral surface of the fit wall 71*b;* and an O-ring 72 as a seal member is mounted in the seal groove 90 to come into close contact with the inner peripheral surface of the valve-operating cam chamber 21. The flange portion 71*a* is secured to the cylinder head 8 by a pair of parallel bolts 91, 91 at locations corresponding to the pair of flat face portions 11*a* and 11*b*.

When the fit wall 71*b* of the head cover 71 is fitted to the inner peripheral surface of the valve-operating cam chamber 21 with the O-ring 72 interposed therebetween in the above manner, a uniform interference can be provided at each of various portions of the O-ring 72 regardless of an axial force of the bolt 91; thereby, ensuring a good sealed state between the cylinder head 8 and the head cover 71. Moreover, the bolt 91 for securing the flange portion 71*a* of the head cover 71 to the cylinder head 8 only performs the securing of the flange portion 71*a* to the cylinder head 8 without participation in the interference for the O-ring 72; and hence, the required number of bolts 91 can be substantially reduced. More particularly, if the flange portion 71*a* of the head cover 71 is secured to the cylinder head 8 by a pair of parallel bolts 91, 91 at locations corresponding to the pair of flat face portions 11*a* and 11*b*, the head cover 71 can be secured simply and reliably with the least number of bolts.

One end of the camshaft 26 protrudes outwards from the cylinder head 8 on the side where the oil seal 28 is located. One end of the crankshaft 13 also protrudes outwards from the crankcase 6 on the same side, while a toothed driving pulley 32 is secured to such one end. As such, a toothed driven pulley 33 having a number of teeth twice the number of the driving pulley 32 is secured to the one end of the camshaft 26. A toothed timing belt 34 is wound around the pulleys 32 and 33 so that the crankshaft 13 can drive the camshaft 26 at a reduction ratio of one half. A valve-operating mechanism 53 is comprised of the camshaft 26 and a timing-transmitting device 35.

Thus, the engine E is constructed into an OHC type, and the timing-transmitting device 35 is disposed as a dry type outside the engine body 1.

Figure 12:
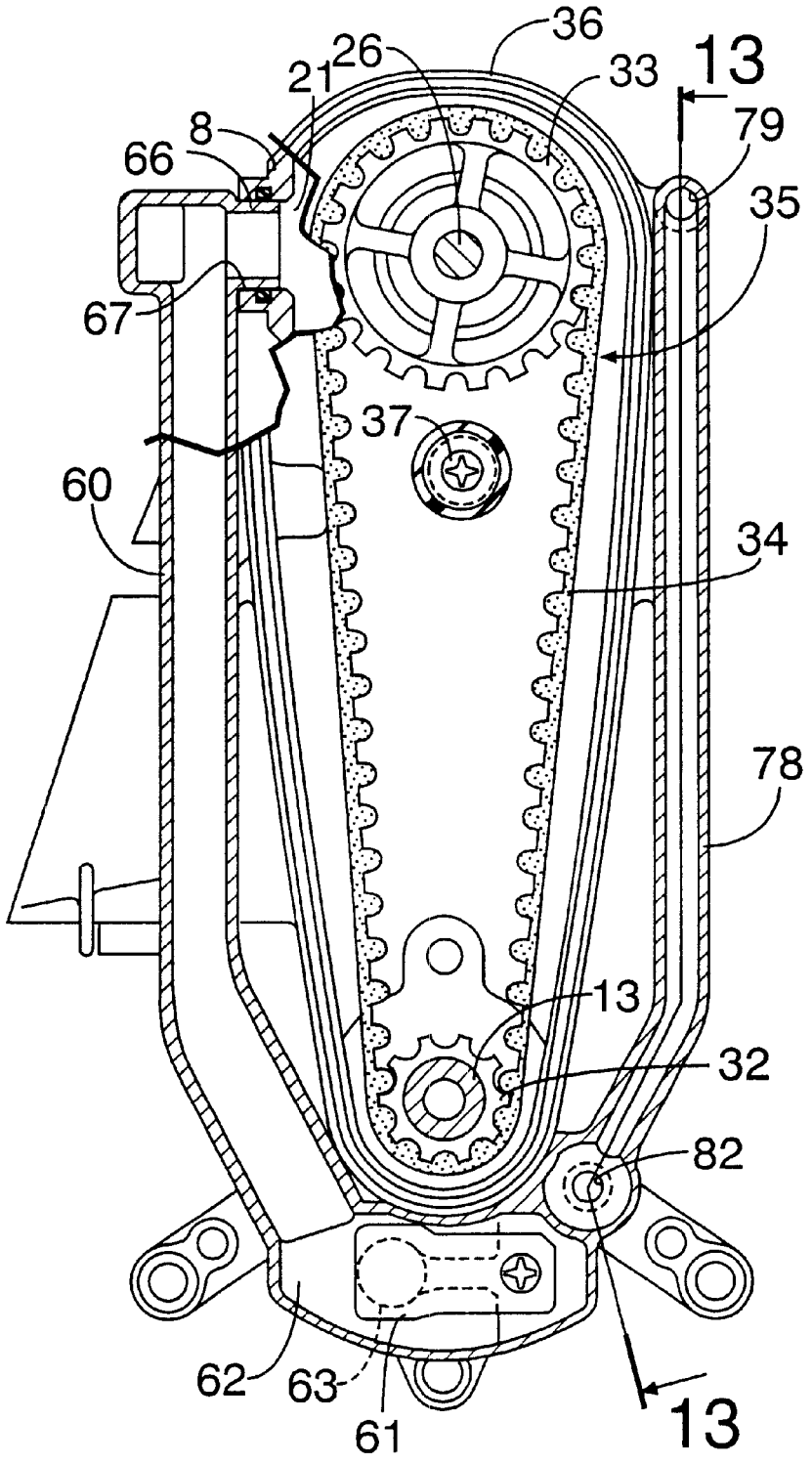
FIG. 12 is a sectional view taken along a line 12—12 in FIG. 3.

As shown in FIGS. 3 and 12, a belt cover 36 made of a synthetic resin is disposed between the engine body 1 and the timing transmitting device 35, and fixed to the engine body 1 by a bolt 37; thereby, avoiding heat radiated from the engine body 1 to influence the timing transmitting device 35.

An oil tank 40 made of a synthetic resin is disposed on 12 the timing transmitting device 35 to cover an outer surface of a portion of the timing transmitting device 35, and secured to the engine body 1 by a bolt 41. Further, a recoiled starter 42 (see FIG. 2) is attached to an outer surface of the oil tank 40.

Referring again to FIG. 2, the other end of the crankshaft 13 opposite from the timing transmitting device 35 also protrudes outwards from the crankcase 6, and a flywheel 43 is secured to this end of the crankshaft 13 by a nut 44. The flywheel 43 has a large number of cooling blades 45 integrally provided on its inner surface to serve as a cooling fan. The flywheel also has a plurality of mounting bosses 46 (one of which is shown in FIG. 2) formed on its outer surface, and a centrifugal shoe 47 is swingably supported on the mounting bosses 46. The centrifugal shoe 47 constitutes a centrifugal clutch 49 together with a clutch drum 48 secured to a drive shaft 50 which will be described hereinafter. When the rotational speed of the crankshaft 13 exceeds a predetermined value, the centrifugal shoe 47 is brought into pressure contact with an inner peripheral wall of the clutch drum 48 by its own centrifugal force, to transmit a torque output from the crankshaft 13 to the drive shaft 50. The flywheel 43 has a diameter larger than that of the centrifugal clutch 48.

An engine cover 51 covering the engine body 1 and its accessories is divided at a location corresponding to the timing transmitting device 35 into a first cover half 51*a* on the side of the flywheel 43, and a second cover half 51*b* on the side of the starter 42. The first and second cover halves 51*a* and 51*b* are secured to the engine body 1. A frustoconical bearing holder 58 is arranged coaxially with the crankshaft 6 and secured to the first cover half 51*a*. The bearing holder 75 supports the cutter C with a bearing 59 interposed therebetween to drive the cutter C to rotate, and an air intake port 52 is provided in the bearing holder 75 so that the extenal air is introduced into the engine cover 51 with rotation of the cooling blades 45. A pedestal 54 is secured to the engine cover 51 and the bearing holder 75 to cover a lower surface of the fuel tank 5.

The second cover half 51*b* defines a timing-transmitting chamber 92 for accommodating the timing-transmitting device 35 by cooperating with the belt cover 36.

Thus, the timing-transmitting device 35 adapted to operate the crankshaft 13 and the camshaft 26 in association with each other is constructed into a dry type, and disposed outside the engine body 1. Therefore, it is unnecessary to specially provide a chamber for accommodating the timing-transmitting device 35 in the sidewall of the engine body 1. Accordingly, it is possible to provide a reduction in wall thickness and a compactness of the engine body 1 in order to achieve a remarkable reduction in weight of the entire engine E.

Moreover, the timing transmitting device 35 and the centrifugal shoe 47 of the centrifugal clutch 49 are connected to opposite ends of the crankshaft 13 with the cylinder block 7 interposed therebetween. Therefore, a good balance of weight is provided between the opposite ends of the crankshaft 13, and the center of gravity of the engine E can be put extremely close to a central portion of the crankshaft 13, to thereby reduce the weight of the engine E and to enhance the operability of the engine E. Furthermore, during the operation of the engine E, a load provided by the timing transmitting device 35 and the drive shaft 50 is applied in a dispersed manner to the opposite ends of the crankshaft 13. Therefore, it is possible to avoid the localization of the load on the crankshaft 13 and the bearings 14 and 14' supporting the crankshaft 13, to threby enhance their durabilities.

The flywheel 43, larger in diameter than the centrifugal shoe 47 and having the cooling blades 45, is secured to the crankshaft 13 between the engine body 1 and the centrifugal shoe 47. Therefore, it is possible to draw in the external air through the air intake port 52 by the rotation of the cooling blades 45 to properly supply it around the cylinder block 7 and the cylinder head 8 without being obstructed by the centrifugal clutch 48; thereby, enhancing the cooling of the cylinder block 7 and the cylinder head 8, while avoiding an increase in size of the engine E due to the flywheel 43 to the utmost.

Further, the oil tank 40 is mounted to the engine body 1 adjacent to and outside the timing transmitting device 35. Therefore, the oil tank 40 covers at least a portion of the timing-transmitting device 35; thereby, protecting the timing-transmitting device 35 in cooperation with the second cover half 51*b* covering the other portion of the timing-transmitting device 35. Moreover, since the oil tank 40 and the flywheel 43 are disposed to oppose to each other with the engine body 1 interposed therebetween, the center of gravity of the engine E can be put close to the central portion of the crankshaft 13.

As shown in FIGS. 5, 11, 14 and 15, an intake tube 94 having the intake port 9 is integrally provided in a projecting manner on one side of the cylinder head 8; and the carburetor 2 is connected to the intake tube 94 through an intake pipe 95 made of an elastomer material; such as, a rubber. One end of the intake pipe 95 is fitted over an outer periphery of the intake tube 94. Further, a clamping ring 96 is fitted over an outer periphery of the intake pipe 95, and a plurality of annular caulking grooves 96*a* are defined on the clamping ring 96. In this manner, the intake pipe 95 is connected to the intake tube 94. A flange 95*a* is formed at the other end of the intake pipe 95, and a support plate 97 and an insulator 98 made of an insulating material are disposed in a superposed relation to each other in such a manner that the flange 95*a* is sandwiched therebetween. A pair of connecting bolts 99 are welded at their heads to the support plate 97 and inserted into a series of bolt bores 100 formed through the insulator 98, the carburetor 2 and a bottom wall of a case 4*a* of the air cleaner 4, and nuts 101 are threadedly fitted and clamped over tip ends of the connecting bolts 99, whereby the intake pipe 95, the insulator 98, the carburetor 2 and the air cleaner 4 are mounted to the support plate 97.

The support plate 97 is integrally formed with a stay 97*a* extending upwards and secured to the cylinder head 8 by a bolt 109.

A heat-shielding air guide plate 102 is disposed between the engine body 1 and carburetor 2. The heat-shielding air guide plate 102 is made of a synthetic resin and integrally connected to one side of the belt cover 36, and has an opening 103 through which the intake pipe 95 is passed. Further, the heat-shielding air guide plate 102 extends, until its lower end reaches near the flywheel, that is, the cooling fan 43.

Thus, cooling air fed from the cooling fan 43 can be guided by the heat-shielding air guide plate 102 to the engine body 1 and particularly to the cylinder head 8, to thereby effectively cool them. The heat-shielding air guide plate 102 is adapted to shield a radiated heat of the engine body 1, to thereby prevent overheating of the carburetor 2. The heat-shielding air guide plate 102 is integrally formed with the belt cover 36; thereby, providing a reduction in number of parts and in its turn, simplifying the structure.

A lubricating system for the engine E will be described below with reference to FIGS. 3, 13 and 16 to 18F.

As shown in FIG. 3, the crankshaft 13 is disposed so that one end thereof is passed through the oil tank 40, while being in close contact with the oil seals 39 and 39' mounted to outer and inner sidewalls of the oil tank 40, respectively. A through-bore 55 is provided in the crankshaft 13 in order to permit the communication between the inside of the oil tank 40 and the crank chamber 6*a*. A lubricating oil is stored in the oil tank 40 in a determined amount so that an end of the through-bore 55 opened into the oil tank 40 is always exposed above the liquid level of the oil O even in any operational position of the engine E.

A bowl-shaped portion 40*a* is formed in an outer wall of the oil tank 40 and recessed into the tank 40. In the oil tank 40, an oil slinger 56 is secured to the crankshaft 13 by a nut 57. The oil slinger 56 includes two blades 56*a* and 56*b* which extend radially opposite to each other from the central portion where the oil slinger 56 is fitted to the crankshaft 13. One of the blades 56*a* is bent at its intermediate portion toward the engine body 1; and the other blade 56*b* is bent at its intermediate portion to extend along a curved surface of the bowl-shaped portion 40*a*. When the oil slinger 56 is rotated by the crankshaft 13, at least any one of the two blades 56*a* and 56*b* scatters the oil O stored in the oil tank 40 even in any operational position of the engine E in order to generate an oil mist.

More particularly, the formation of the bowl-shaped portion 40*a* on the outer wall of the oil tank 40 ensures that a dead space within the oil tank 40 can be reduced. Moreover, the oil present around the bowl-shaped portion 40*a* can be stirred and scattered by the blade 56*b* even in a laid-sideways position of the engine E with the bowl-shaped portion 40*a* facing downwards.

The oil seal 39 is attached to the central point of the bowl-shaped portion 40*a* to come into close contact with the outer peripheral surface of the crankshaft 13 passing through the bowl-shaped portion 40*a;* and a driven member 84 is disposed within the bowl-shaped portion 40*a* and secured to a tip end of the crankshaft 13 so that it is driven by the recoiled starter 42.

With the above-described structural arrangement, a space in the bowl-shaped portion 40*a* can be effectively utilized f or the disposition of the driven member 84; and the recoiled starter 42 can be disposed in proximity to the oil tank 40, which can contribute to the compactness of the entire engine E.

Figure 17:
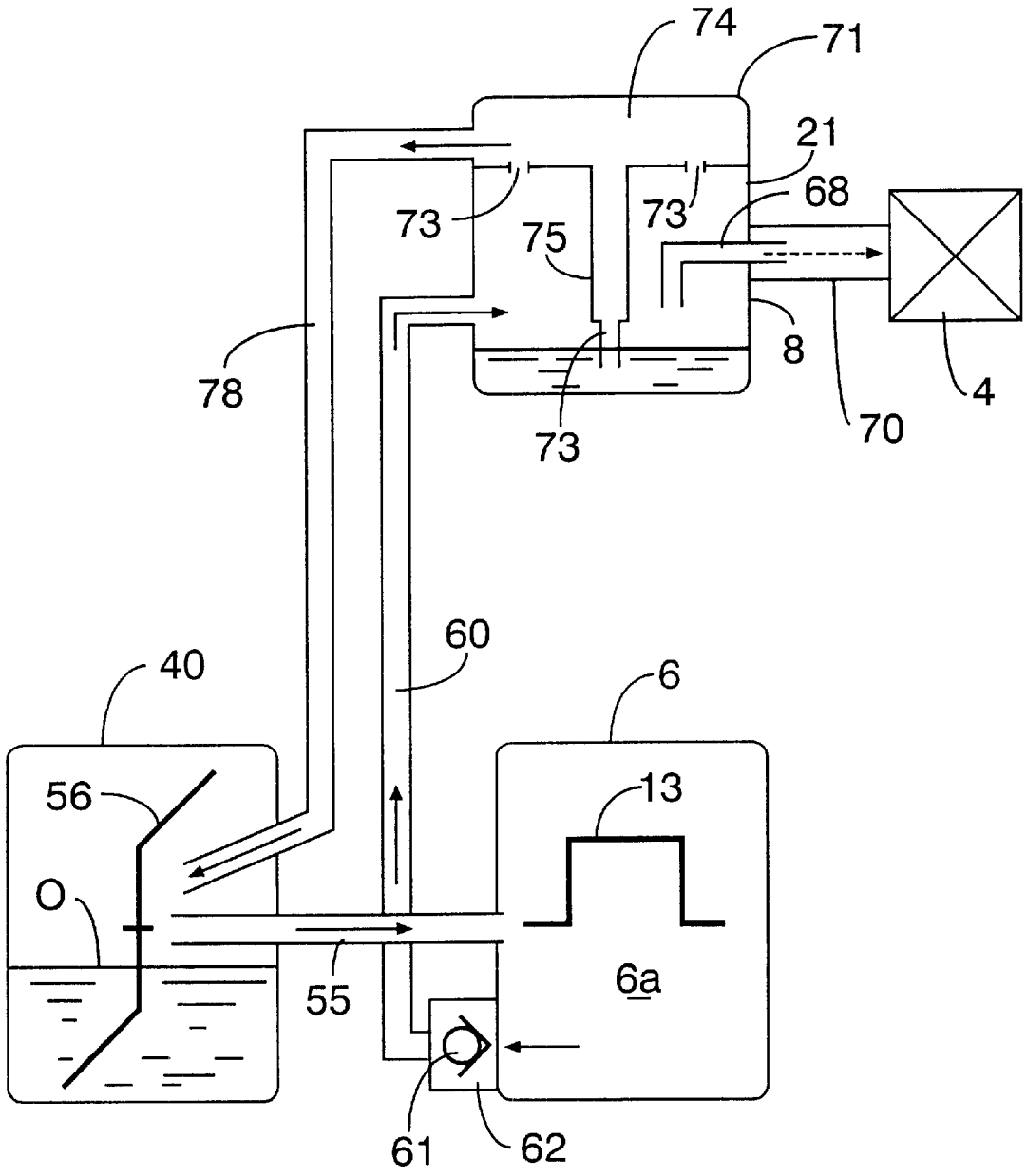
FIG. 17 is a diagram of a lubricating system in the engine.
Figure 18A:
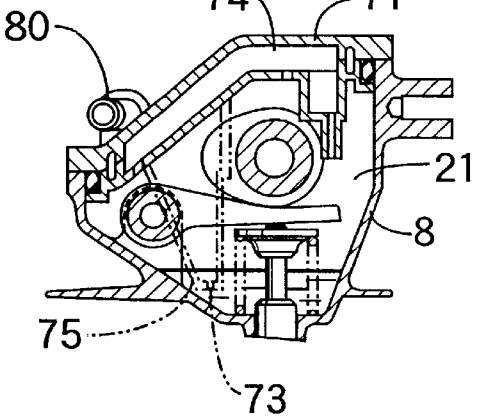
FIGS. 18A to 18F are views for explaining an action of drawing up an oil accumulated in a cylinder head in various operational positions of the engine.
Figure 18B:
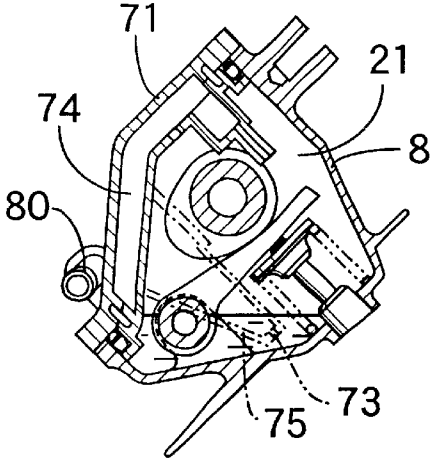
Figure 18C:
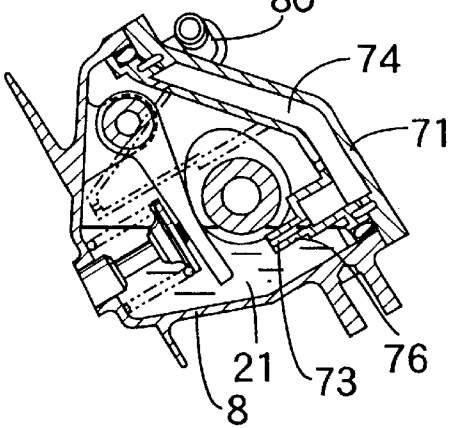
Figure 18D:
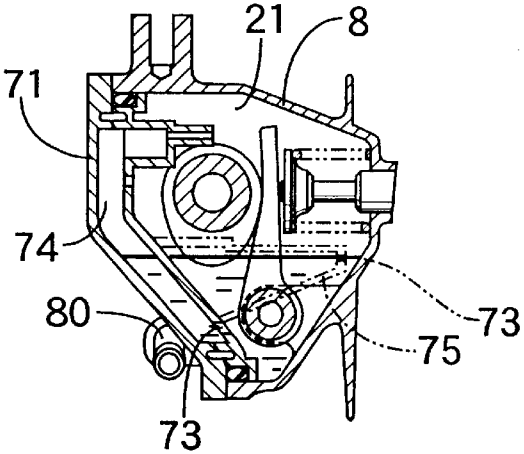
Figure 18E:
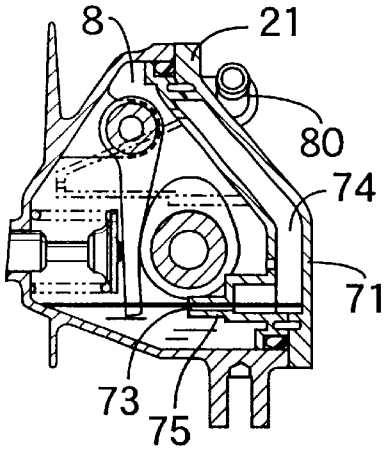
Figure 18F:
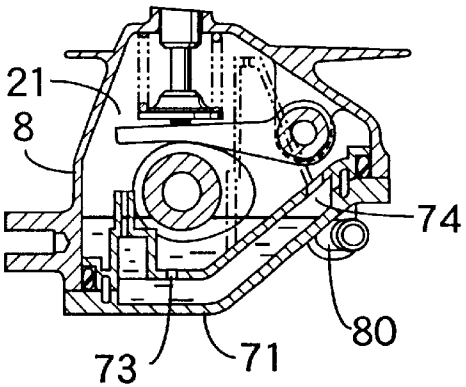

Referring to FIGS. 3, 12 and 17, the crank chamber 6*a* is connected to the valve-operating cam chamber 21 through an oil-feed conduit 60, and a one-way valve 61 is incorporated in the oil-feed conduit 60 for permitting a flow of oil in only one direction from the crank chamber 6*a* toward the valve-operating cam chamber 21. The oil-feed conduit 60 is integrally formed on the belt cover 36 in order to extend along one sidewall of the belt cover 36, with its lower end formed in a valve chamber 62. An inlet pipe 63 is integrally formed on the belt cover 36 in order to protrude from the valve chamber 62 at the back of the belt cover 36, and is fitted into a connecting bore 64 in a lower portion of the crankcase 6 with a seal member 65 interposed therebetween, to communicate with the crank chamber 6*a*. The one-way valve 61 is disposed in the valve chamber 62 to permit the flow of oil in only one direction from the inlet pipe 63 toward the valve chamber 62. The one-way valve 61 is a reed valve in the illustrated embodiment.

An outlet pipe 66 is integrally formed on the belt cover 36 in order to protrude from an upper end of the oil-feed conduit 60 at the back of the belt cover 36, and is fitted into a connecting bore 67 in a side of the cylinder head 8, to thereby communicate with the valve-operating cam chamber 21.

The head cover 71 is comprised of an outer cover plate 105 made of a synthetic resin and having the flange portion 71*a,* and an inner cover plate 106 made of a synthetic resin and having the fit wall portion 71*b,* the outer and inner cover plates 105 and 106 being friction-welded to each other. The outer and inner cover plates 105 and 106 are formed to define a drawing-up chamber 74 therebetween.

The drawing-up chamber 74 is of a flat shape to extend over the upper face of the valve-operating cam chamber 21, and four orifices 73 are defined at four points in the bottom wall of the drawing-up chamber 74; i.e., the inner cover plate 105. Two long and short drawing-up pipes 75 and 76 are integrally formed in the bottom wall of the drawing-up chamber 74 at central portions thereof, and arranged at a distance along a direction perpendicular to the axis of the camshaft 26, to protrude into the valve-operating cam chamber 21, and an orifice 73 is provided in each of the drawing-up pipes 75 and 76.

Figure 13:
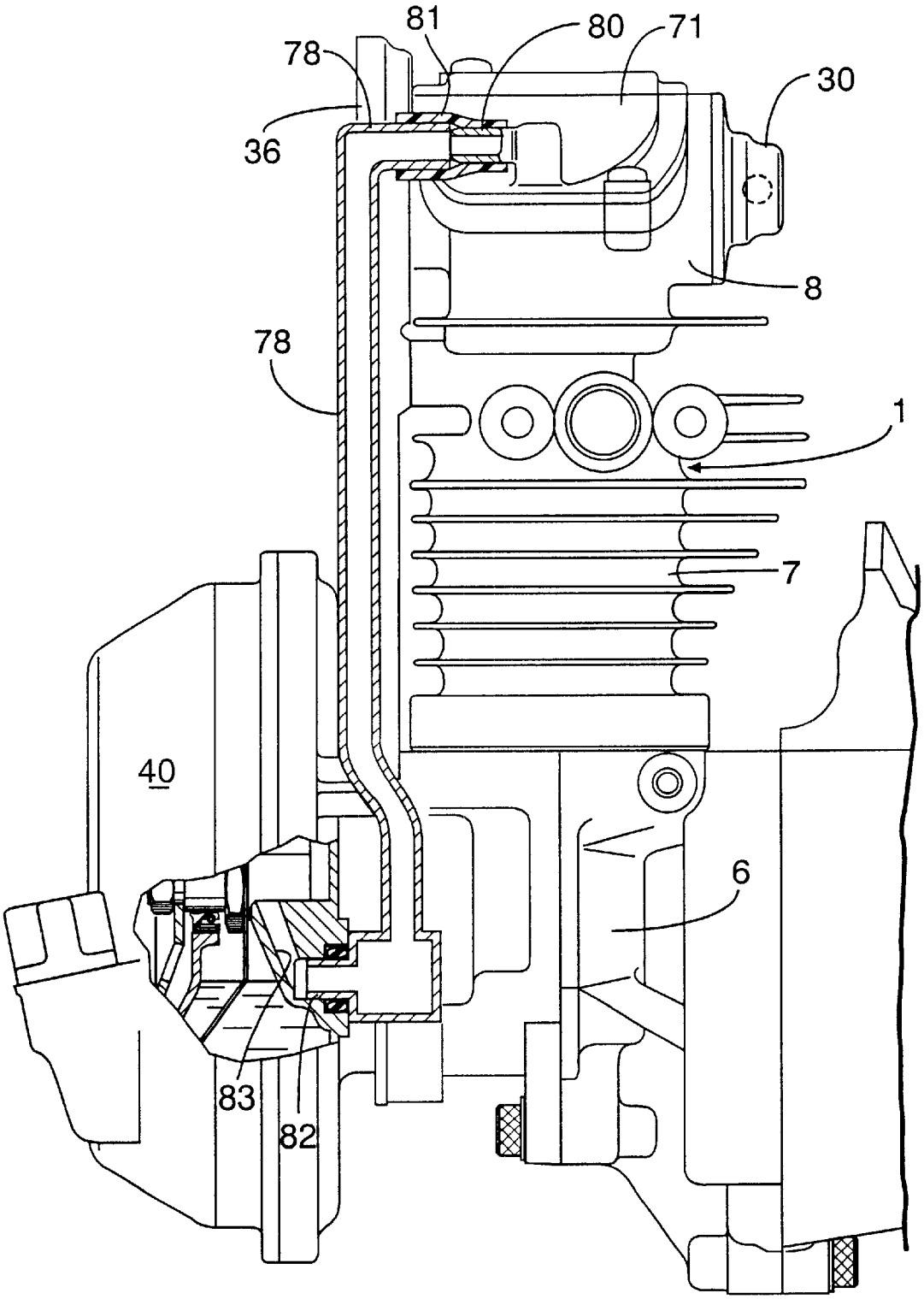
FIG. 13 is a sectional view taken along a line 13—13 in FIG. 12.
Figure 14:
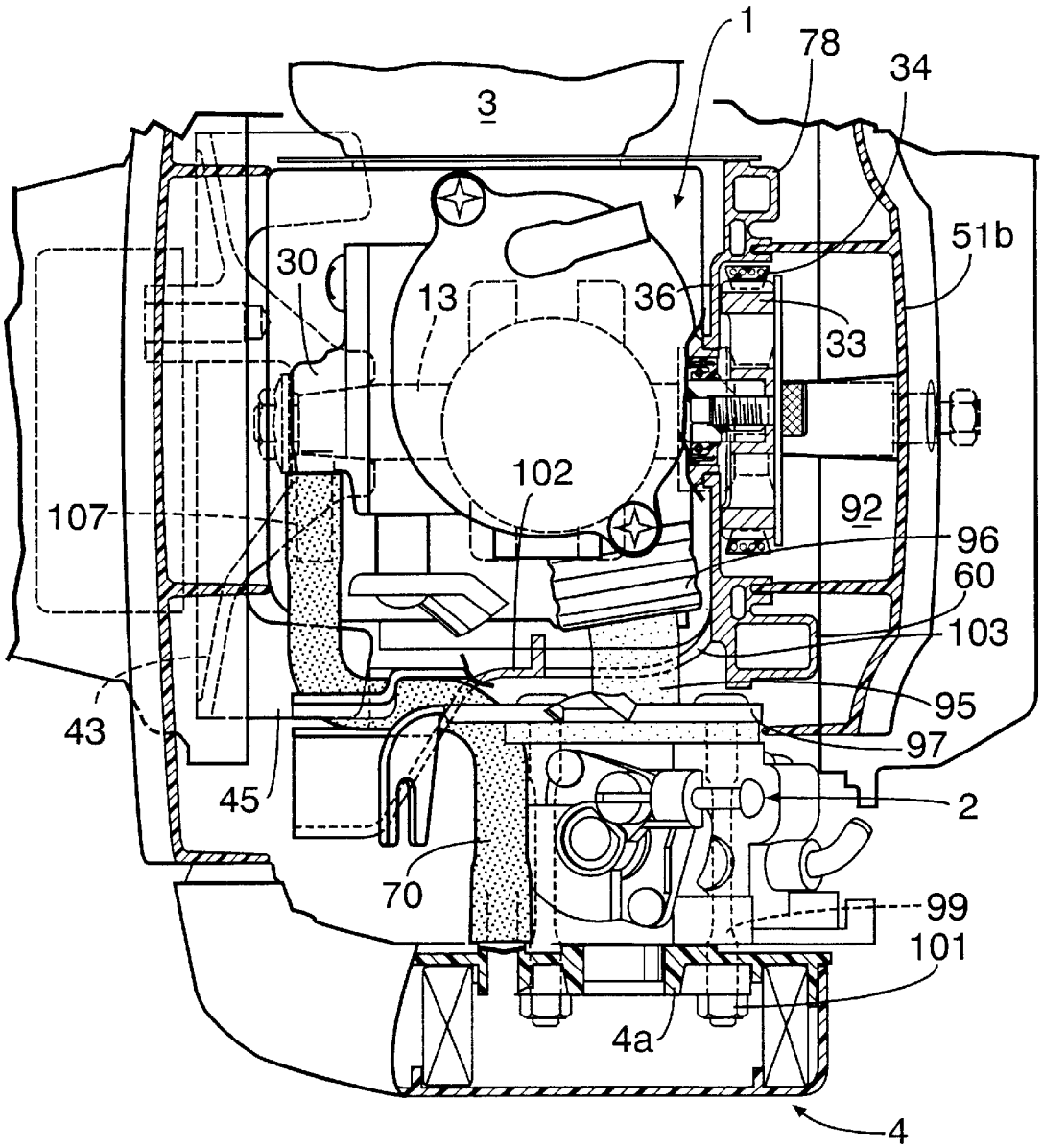
FIG. 14 is a sectional view taken along a line 14—14 in FIG. 11.
Figure 15:
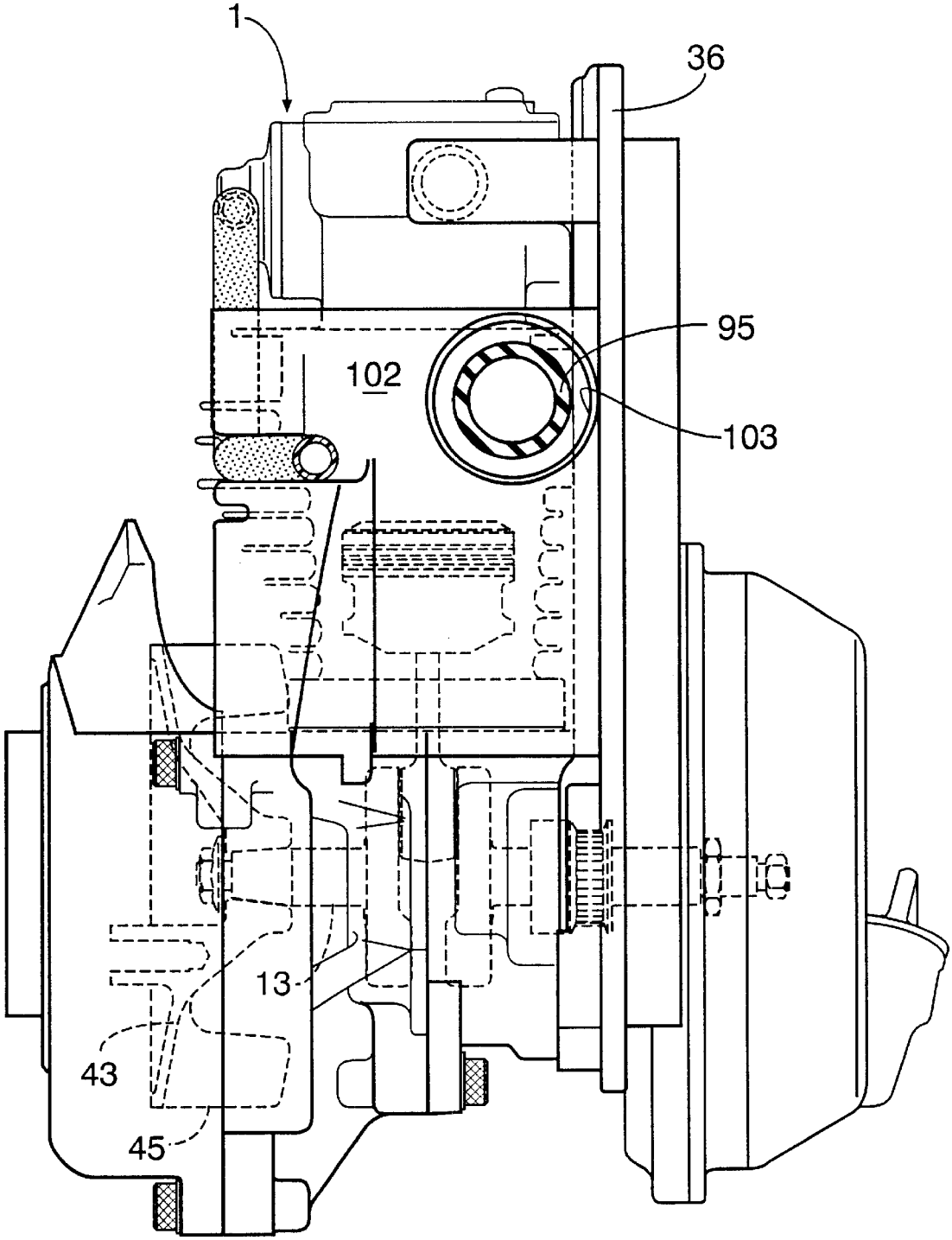
FIG. 15 is a sectional view taken along a line 15—15 in FIG. 11.

As shown in FIGS. 12, 13 and 17, the drawing-up chamber 74 also communicates with the inside of the oil tank 40 through an oil-return conduit 78. The oil-return conduit 78 is integrally formed on the belt cover 36 in order to extend along the other side edge opposite from the oil-feed conduit 60. An inlet pipe 79 is integrally formed on the belt cover 36 in order to protrude from an upper end of the oil-return pipe 78 at the back of the belt cover 36, and connected to an outlet pipe 80 formed in the head cover 71 through a connector 81, to communicate with the drawing-up chamber 74.

An outlet pipe 82 is integrally formed in the belt cover 36 in order to protrude from a lower end of the oil-return conduit 78 at the back of the belt cover 36 and is fitted into a return bore 83 provided in the oil tank 40 so as to communicate with the inside of the oil tank 40. An open end of the return bore 83 is disposed in the vicinity of a central portion of the inside of the oil tank 40 so that it is exposed above the liquid level of the oil in the oil tank 40 even in any operational position of the engine E.

As best shown in FIG. 4, a breather passage 68 is provided in the camshaft 26. The breather passage 68 comprises a shorter side bore 68*a* as an inlet which opens at an axially intermediate portion of the camshaft 26 toward the valve-operating cam chamber 21, and a longer through bore 68*b* which communicates with the side bore 68*a* and which extends through a center portion of the camshaft 26 and opens at an end face thereof on the side of the bearing cap 30. An enlarged breather chamber 69 is defined in the bearing cap 30 in order to communicate with an exit of the through bore 68*b;* and a pipe-connecting tube 107 is formed on the baring cap 30 and protrudes from an outer surface thereof to communicate with the breather chamber 69. The breather chamber 69 communicates with the inside of the air cleaner 4 through a breather pipe 70 connected to the pipe-connecting tube 107.

The ball bearing 27' retained on the bearing cap 30 is formed in a sealed structure including a seal member 108 on a side facing the breather chamber 69. Therefore, the oil mist in the valve-operating cam chamber 21 can lubricate the ball bearing 27', but cannot reach the breather chamber 69 through the bearing 27'.

Thus, when the oil slinger 56 scatters the lubricating oil O in the oil tank 40 by the rotation of the crankshaft 13 during the operation of the engine E, to generate the oil mist. When the pressure in the crank chamber 6*a* decreases due to the ascending movement of the piston 15, the oil mist is drawn into the crank chamber 6*a* through the through-bore 55, to thereby lubricate the crankshaft 13 and the periphery of the piston 15. When the pressure in the crank chamber 6*a* increases due to the descending movement of the piston 15, the one-way valve 61 opens, so that the oil mist ascends through the oil-feed conduit 60 along with a blow-by gas generated in the crank chamber 6*a* and is supplied to the valve-operating cam chamber 21, to thereby lubricate the camshaft 26, the rocker arms 24 and 25 and the others.

When the oil mist and the blow-by gas in the valve-operating cam chamber 21 flow into the side bore 68*a* of the breather passage 68 in the camshaft 26 which is being rotated, they are separated from each other by centrifugal force in the rotated side bore portion 68*a*. Then, the oil is returned to the valve-operating cam chamber 21; and the blow-by gas is drawn into the engine E sequentially through the side bore 68*a* and the through bore 68*b* in the breather passage 68, the breather chamber 69, the breather pipe 70 and the air cleaner 4.

The breather chamber 69 and the pipe-connecting tube 107 connecting the breather pipe 70 are formed in and on the bearing cap 30 retaining the ball bearing 27' for supporting the camshaft 26, as described above. Therefore, the bearing cap 30 also serves as a transfer member for transferring the blow-by gas to the breather pipe. Hence, it is possible to simplify the structure and reduce the number of parts.

The valve-operating cam chamber 21 communicates with the inside of the air cleaner 4 through the breather passage 68, the breather chamber 69 and the breather pipe 70, as described above; and hence, the pressure in the valve-operating cam chamber 21 is maintained at a level equal to or slightly lower than the atmospheric pressure.

On the other hand, the crank chamber 6*a* has an average negative pressure state by discharging only the positive-pressure component of pressure pulsations in the crank chamber 6*a* through the one-way valve 61. The negative pressure in the crank chamber 6*a* is transmitted to the oil tank 40 via the through-bore 55 and further to the drawing-up chamber 74 through the oil-return conduit 78. Therefore, the pressure in the drawing-up chamber 74 is lower than that in the valve-operating cam chamber 21; and the pressure in the oil tank 40 is lower than that in the drawing-up chamber 74. As a result, the pressure is transferred from the valve-operating cam chamber 21 through the drawing-up pipes 75 and 76 and the orifices 73 into the drawing-up chamber 74, and further through the oil-return conduit 78 into the oil tank 40. Accompanying this transfer, the oil mist within the valve-operating cam chamber 21 and the oil liquefied and retained in the valve-operating cam chamber 21 are drawn up into the drawing-up chamber 74 through the drawing-up pipes 75 and 76 and the orifices 73, and returned to the oil tank 40 through the oil-return conduit 78.

In this case, any of the six orifices 73 is immersed in the oil retained in the valve-operating cam chamber 21 even in any operational position of the engine E such as an upright state (in FIG. 18A), a leftward tilted state (in FIG. 18B), a rightward tilted state (in FIG. 18C), a leftward laid state (in FIG. 18D), a rightward laid state (in FIG. 18E) and an upside down state (in FIG. 18F), as shown in FIGS. 18A to 18F, whereby the oil can be drawn up into the drawing-up chamber 74, because the four orifices 73 are provided at four points of the bottom wall of the drawing-up chamber 74, and the orifices 73 are provided in the two long and short drawing-up pipes 75 and 76 which are arranged at a distance along the direction perpendicular to the axis of the camshaft 26 and protrude from the central portion of the bottom wall into the valve-operating cam chamber 21, as described above.

Thus, the oil mist generated in the oil tank 40 is supplied to the crank chamber 6*a* and the valve-operating cam chamber 21 of the OHC-type 4-cycle engine E and returned to the oil tank 40 by utilizing the pulsation of pressure in the crank chamber 6*a* and the function of the one-way valve 61. Therefore, even in any operational position of the engine E, the inside of the engine can be reliably lubricated by the oil mist. Moreover, a pump exclusively for circulating the oil mist is not required and hence, it is possible to simplify the structure.

Not only the oil tank 40 made of a synthetic resin, but also the oil-feed conduit 60 providing communication between the crank chamber 6*a* and the valve-operating cam chamber 21 and the oil-return conduit 78 providing communication between the drawing-up chamber 74 and the oil tank 40 are disposed outside the engine body 1. Therefore, it is possible to substantially contribute to a reduction in weight of the engine E without obstructing a reduction in thickness and compactness of the engine body 1. More particularly, the oil-feed conduit 60 and the oil-return conduit 78 disposed outside the engine body 1 are difficult to be influenced by the heat from the engine body 1; and hence, it is possible to avoid overheating of the lubricating oil 0. In addition, integral formation of the oil-feed conduit 60 and the oil-return conduit 78 with the belt cover 46 can contribute to a reduction in number of parts and an enhancement in assemblage by.

Although the embodiment of the present invention has been described in detail, it will be understood that the present invention is not limited to the above-described embodiment, and various modifications in design may be made without departing from the spirit and scope of the invention defined in the claims.

What is claimed is:

1. A valve-operating device with a breather system in an engine, comprising a camshaft including a breather passage, the camshaft being disposed in a valve-operating cam chamber and being carried on an engine body in such a manner that an inlet of said breather passage opens into an outer peripheral surface of the camshaft and an outlet of said breather passage communicates with an intake system, wherein a bearing cap is detachably secured to the engine body for supporting an outer peripheral surface of one end portion of said camshaft with a bearing interposed therebetween, said bearing cap having a breather chamber provided therein to communicate with the outlet of said breather passage, said bearing cap being integrally formed at an outer peripheral surface thereof with a pipe-connecting portion to which a breather pipe communicating with said breather chamber and connected to the intake system is connected.

2. A valve-operating device with a breather system in an engine according to claim 1, wherein said bearing is a sealed bearing including a seal member on a side facing the breather chamber.

* * * * *